US007317370B2

(12) United States Patent
Nakamoto et al.

(10) Patent No.: US 7,317,370 B2
(45) Date of Patent: Jan. 8, 2008

(54) IGNITION COIL

(75) Inventors: Kiyotoshi Nakamoto, Kariya (JP); Yoshitaka Satoh, Toyohashi (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/707,950

(22) Filed: Feb. 20, 2007

(65) Prior Publication Data

US 2007/0210888 A1 Sep. 13, 2007

(30) Foreign Application Priority Data

Mar. 9, 2006 (JP) ..... 2006-064486
Mar. 9, 2006 (JP) ..... 2006-064487
Mar. 9, 2006 (JP) ..... 2006-064488

(51) Int. Cl.
*H01F 27/02* (2006.01)
*H01F 38/12* (2006.01)

(52) U.S. Cl. ..... 336/92; 336/90; 336/96; 123/634; 123/635

(58) Field of Classification Search ..... 336/96, 336/92, 90; 123/634–635
See application file for complete search history.

(56) References Cited

U.S. PATENT DOCUMENTS 6,332,458 B1 * 12/2001 Shimada et al. ..... 123/634
6,845,764 B1 * 1/2005 Skinner et al. ..... 123/634
7,013,883 B2 * 3/2006 Shimada et al. ..... 123/634
7,228,853 B1 * 6/2007 Skinner et al. ..... 123/634
2003/0037745 A1 * 2/2003 Moga et al. ..... 123/143 C
2005/0174206 A1 8/2005 Fujiyama

* cited by examiner

*Primary Examiner*—Anh Mai
(74) *Attorney, Agent, or Firm*—Nixon & Vanderhye P.C.

(57) ABSTRACT

An ignition coil includes a coil portion that has a primary coil, a secondary coil, and an outer core. The outer core is arranged on a radially outer side of both the primary coil and the secondary coil. A fitting member, which is in a substantially cylindrical shape, has an inner periphery via which the fitting member is fitted to the outer core. A connector case has a fit hole via which the connector case is fitted to an outer periphery of the fitting member. The connector case connects with an axial end of the coil portion via the fitting member. The fitting member includes an embedded member that is at least partially embedded in the fitting member. The embedded member is formed of a material that is different in Young's modulus from a material constructing the fitting member.

14 Claims, 16 Drawing Sheets

IGNITION COIL

CROSS REFERENCE TO RELATED APPLICATIONS

This application is based on and incorporates herein by reference Japanese Patent Applications No. 2006-64486 filed on Mar. 9, 2006, No. 2006-64487 filed on Mar. 9, 2006, and No. 2006-64488 filed on Mar. 9, 2006.

FIELD OF THE INVENTION

The present invention relates to an ignition coil.

BACKGROUND OF THE INVENTION

An ignition coil for an internal combustion engine includes a primary coil, which is formed by winding an electrical wire around a primary spool, and a secondary coil, which is formed by winding an electrical wire around a secondary spool. The primary coil is arranged concentrically with respect to the secondary coil.

A center core made of a magnetic material is arranged on a radially inner side of the primary coil and the secondary coil. An outer core made of a magnetic material is arranged on the radially outer side of the primary coil and the secondary coil. In this structure, a magnetic path is defined through the center core and the outer core. A thermosetting resin such as epoxy resin is charged into a clearance formed in the ignition coil.

A stick-type ignition coil includes the primary coil, the secondary coil, the center core, the outer core, and the like. A coil portion of the stick-type ignition coil is arranged in a plughole of an engine. The coil portion of the stick-type ignition coil has an axial end provided with a connector case. The connector case includes a connector portion, through which electric power is supplied to the primary coil. The connector case further includes a flange portion, via which the ignition coil is fixed to an engine.

With a stick-type ignition coil in US 2005/0174206 A1 (JP-A-2005-260209), a connector case (control unit) is assembled to an axial end of a coil portion via a cylindrical-shaped fitting member (terminal assembly). The fitting member restricts leakage of epoxy resin charged in a clearance defined in the ignition coil. The fitting member is provided with a current-carrying terminal. The fitting member has an annular groove at which the fitting member is bendable. When the coil portion is fitted into the connector case with the fitting member therebetween, the fitting member is restricted from cracking by flexing the fitting member at the annular groove. The annular groove formed on the fitting member is not charged with resin. Therefore, the ignition coil is decreased in bending strength, even though the ignition coil is improved in quality of assembly.

In addition, the location, in which the fitting member is fitted to the connector case, overlaps the location, in which the fitting member is fitted to the outer core, with respect to the axial direction. The connector case is fitted to the outer periphery of the fitting member at the location, in which the outer core is fitted to the fitting member.

The coil portion is inserted into the plughole, so that the ignition coil is assembled to the engine. In this condition, when bending load acts on the ignition coil due to vibrations of the engine, stress is concentrated on the fitting member and the fitting portion.

The ignition coil is assembled with a spark plug, and the ignition coil and the spark plug are inserted into the plughole. In this condition, when the ignition coil, the spark plug, and the plughole are radially misaligned relative to each other, bending load is initially applied to the ignition coil. Bending load is further applied to the ignition coil due to vibration of the engine, and consequently, the ignition coil further decreases in bending strength.

SUMMARY OF THE INVENTION

The present invention addresses the above disadvantage. According to one aspect of the present invention, an ignition coil includes a coil portion that includes a primary coil, a secondary coil, a center core, and an outer core. The center core is arranged on a radially inner side of both the primary coil and the secondary coil. The outer core is arranged on a radially outer side of both the primary coil and the secondary coil. The ignition coil further includes a fitting member that is in a substantially cylindrical shape. The fitting member has an inner periphery via which the fitting member is fitted to the outer core. The ignition coil further includes a connector case that includes a connector portion and a flange portion. The connector case has a fit hole via which the connector case is fitted to an outer periphery of the fitting member. The connector case connects with an axial end of the coil portion via the fitting member. The fitting member includes a reinforcement member that is at least partially embedded in the fitting member. The fitting member is formed of thermoplastic resin. The reinforcement member is formed of a material that is greater in Young's modulus than the thermoplastic resin constructing the fitting member.

According to another aspect of the present invention, an ignition coil includes a coil portion that includes a primary coil, a secondary coil, a center core, and an outer core. The center core is arranged on a radially inner side of both the primary coil and the secondary coil. The outer core is arranged on a radially outer side of both the primary coil and the secondary coil. The ignition coil further includes a fitting member that is in a substantially cylindrical shape. The fitting member has an inner periphery via which the fitting member is fitted to the outer core. The ignition coil further includes a connector case that includes a connector portion and a flange portion. The connector case has a fit hole via which the connector case is fitted to an outer periphery of the fitting member. The connector case connects with an axial end of the coil portion via the fitting member. The fitting member includes an elastic member that is at least partially embedded in the fitting member. The elastic member is formed of a material that is less in Young's modulus than a material constructing the fitting member.

According to another aspect of the present invention, an ignition coil includes a coil portion that includes a primary coil, a secondary coil, a center core, and an outer core. The center core is arranged on a radially inner side of both the primary coil and the secondary coil. The outer core is arranged on a radially outer side of both the primary coil and the secondary coil. The ignition coil further includes a fitting member that is in a substantially cylindrical shape. The fitting member has one axial end and an other axial end. The other axial end has an inner periphery via which the fitting member is fitted to the outer core. The ignition coil further includes a connector case that includes a connector portion and a flange portion. The connector case has a fit hole via which the connector case is fitted to an outer periphery of the one axial end of the fitting member. The connector case connects with an axial end of the coil portion via the fitting member. The fitting member is fitted to the connector case in a first fit region. The fitting member is fitted to the outer core in a second fit region. The first fit region is axially distant from the second fit region.

According to another aspect of the present invention, an ignition coil includes a coil portion that includes a primary coil, a secondary coil, a center core, and an outer core. The center core is arranged on a radially inner side of both the primary coil and the secondary coil. The outer core is arranged on a radially outer side of both the primary coil and the secondary coil. The ignition coil further includes a fitting member that is in a substantially cylindrical shape. The fitting member has an inner periphery via which the fitting member is fitted to the outer core. The ignition coil further includes a connector case that has a fit hole via which the connector case is fitted to an outer periphery of the fitting member. The connector case connects with an axial end of the coil portion via the fitting member. The fitting member includes an embedded member that is at least partially embedded in the fitting member. The embedded member is formed of a material that is different in Young's modulus from a material constructing the fitting member.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

The first embodiment is described with reference to FIGS. 1 to 6.

Figure 1:
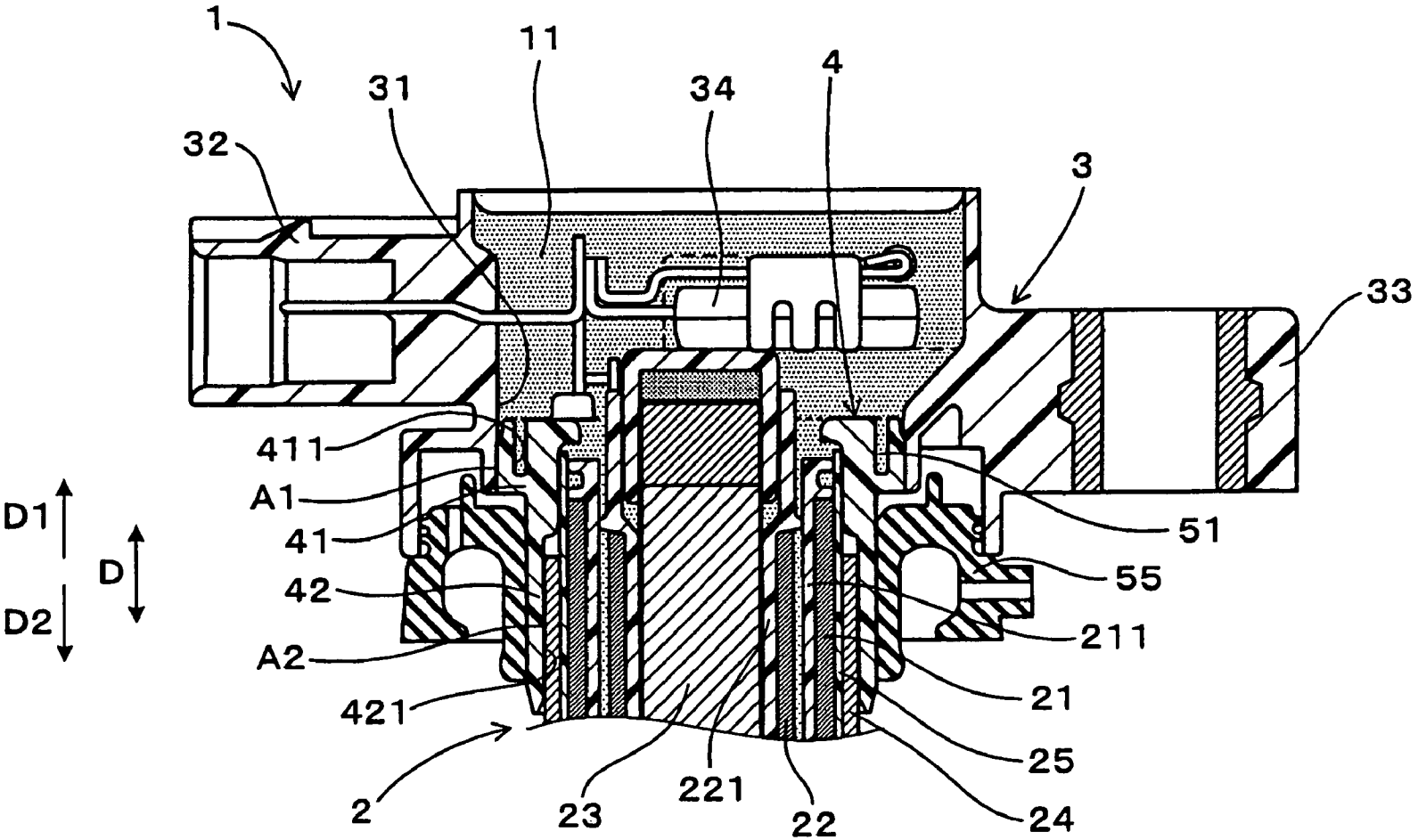
FIG. 1 is a partially sectional view showing an ignition coil including a fitting member connecting a coil portion with a connector case, according to a first embodiment.

As shown in FIG. 1, an ignition coil 1 includes a coil portion 2 constructed of a primary coil 21 and a secondary coil 22. One axial end of the coil portion 2 on the side of D1 is assembled to a connector case 3 via a cylindrical-shaped fitting member 4. The connector case 3 includes a connector portion 32 and a flange portion 33. A center core 23 made of a magnetic material is arranged on the radially inner side of the primary coil 21 and the secondary coil 22. An outer core 24 made of a magnetic material is arranged on the radially outer side of the primary coil 21 and the secondary coil 22.

The connector case 3 has a fit hole 31. The fitting member 4 has the outer periphery on the side of the D1. This outer periphery of the fitting member 4 is fitted into the fit hole 31. The fitting member 4 has the inner periphery on the side of D2. This inner periphery of the fitting member 4 on the side of the D2 is fitted to the outer core 24. A reinforcement member 51 is embedded into the fitting member 4. The reinforcement member 51 is formed of a material that has the Young's modulus greater than the Young's modulus of thermoplastic resin, which constructs the fitting member 4.

Figure 2:
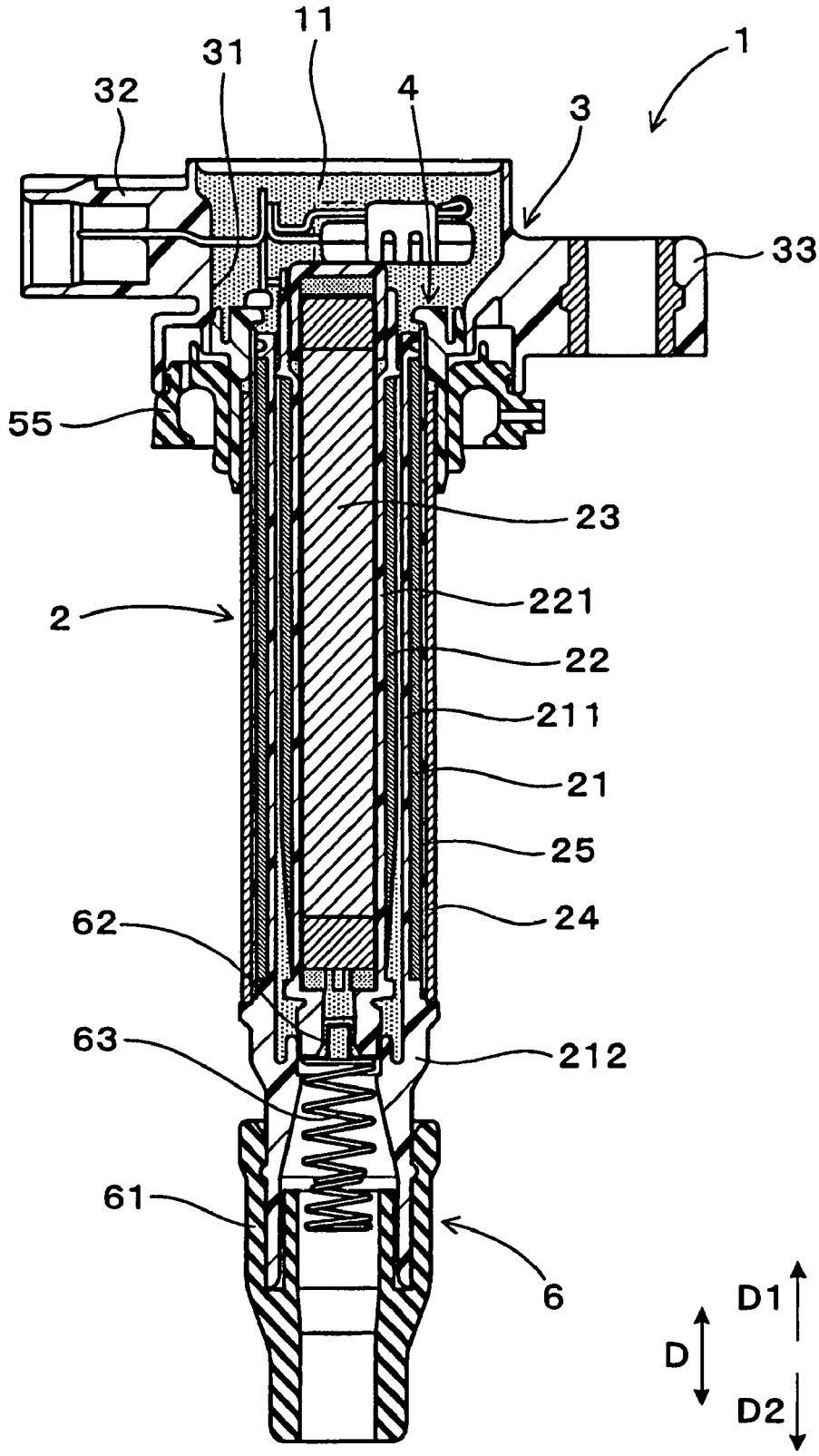
FIG. 2 is a partially longitudinal sectional view showing the ignition coil.
Figure 3:
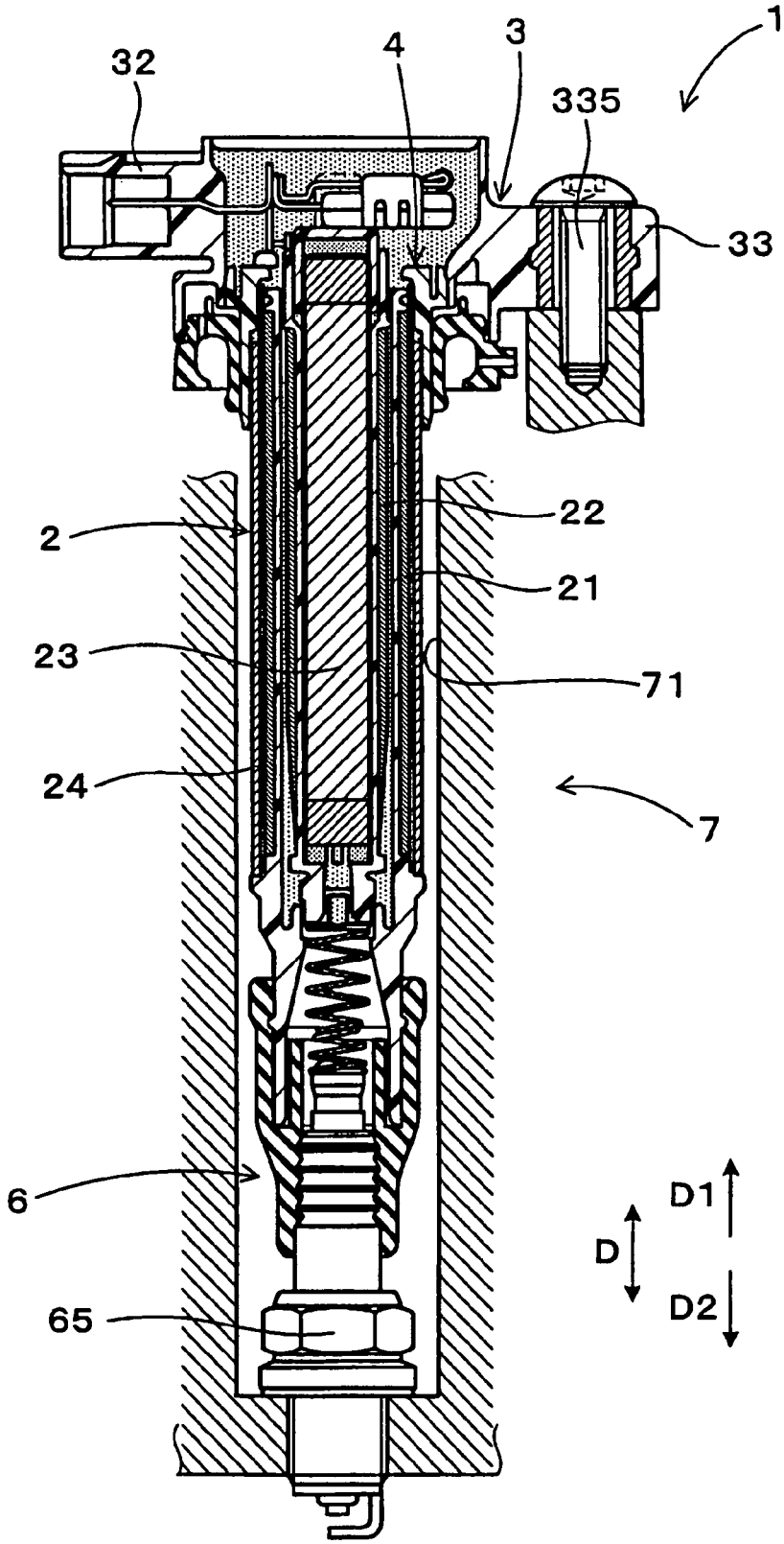
FIG. 3 is a partially longitudinal sectional view showing the ignition coil provided in a plug hole of an internal combustion engine.

As shown in FIGS. 2, 3, a plug mount 6 is provided to the other axial end of the ignition coil 1 on the side of the D2. A spark plug 65 is mounted to the plug mount 6. The ignition coil 1 is a stick-type ignition coil. The ignition coil 1 includes the coil portion 2 and the plug mount 6. The coil portion 2 and the plug mount 6 are arranged in a plughole 71 of an engine 7. The ignition coil 1 includes a flange 33 on the connector case 3. The ignition coil 1 is assembled into the plughole 71, thereby being fixed to the engine 7 via a bolt 335 and the flange 33.

As referred to FIG. 1, the connector case 3 includes the connector portion 32. The ignition coil 1 is electrically connected to an electronic control unit (ECU) via the connector portion 32. The ignition coil 1 is fixed to a cylinder head of the engine 7 via the flange 33. The connector portion 32 and the flange 33 project radially outward from the connector case 3. An igniter 34 is arranged in the connector case 3. The igniter 34 serves as an electronic part provided with an electricity supply circuit and the like. The connector case 3 including the connector portion 32 and the flange 33 is made of thermoplastic resin. The fitting member 4 is also made of thermoplastic resin.

As referred to FIGS. 1, 2, the primary coil 21 is formed by winding a primary wire with insulative coating for multiple turns around the outer peripheral surface of a primary spool 211. The primary spool 211 is made of thermoplastic resin to be annular-shaped in cross section. The secondary coil 22 is formed by winding a secondary wire with insulative coating for the number of turns greater than that of the primary wire around the outer peripheral surface of a secondary spool 221. The secondary wire is less than the primary wire in diameter. The secondary spool 221 is made of thermoplastic resin to be annular-shaped in cross section. In this embodiment, the secondary coil 22 is inserted into the inner periphery of the primary coil 21, and the center core 23 is inserted into the inner periphery of the secondary coil 22.

A coil case 25 is arranged on the radially outer side of the primary coil 21. The coil case 25 is made of thermoplastic resin to be annular-shaped in cross section. In this embodiment, the center core 23 is formed by stacking flat magnetic steel plates such as silicon steel plates, each being in a flat shape, with respect to the radial direction of the ignition coil 1, such that the center core 23 has a substantially circular cross section. The outer core 24 in this embodiment is formed by laminating rolled magnetic steel sheets such as silicon steel plates, each being cylindrical-shaped, around the outer peripheral surface of the coil case 25. The outer core 24 in this embodiment is arranged on the outer periphery of the coil case 25.

As shown in FIG. 2, the plug mount 6 in this embodiment is formed by attaching a rubber plug cap 61 to a mount base portion 212, which extends from the other axial end of the primary spool 211 on the side of the D2. A high-voltage terminal 62 is arranged on the other axial end of the primary spool 211 on the side of the D2. A coil spring 63 is mounted to the high-voltage terminal 62. The coil spring 63 is adapted to make contact with a terminal of the spark plug 65. A winding end of the secondary coil 22 on a high-voltage side is conducted electrically to the terminal of the spark plug 65 via the high-voltage terminal 62 and the coil spring 63. An insulator portion of the spark plug 65 is fitted into a hollow hole in the plug cap 61, so that a terminal provided to a tip end of the insulator portion is brought into contact with the coil spring 63. In this condition, the spark plug 65 is fixed to the cylinder head of the engine 7.

As referred to FIG. 1, the fitting member 4 in this embodiment is made of thermoplastic resin to be annular-shaped in cross section. A case fitting portion 41 is formed on the axial end of the fitting member 4 on the side of the D1. The case fitting portion 41 is fitted into the fit hole 31 of the connector case 3. A core fitted portion 42 is formed on the other axial end of the fitting member 4 on the side of the D2. The core fitted portion 42 is fitted to the outer core 24. An annular fit groove 421 is formed on the inner periphery of the core fitted portion 42. The annular fit groove 421 is fitted to the outer core 24. The axial end of the outer core 24 on the side of the D1 is fitted into the annular fit groove 421 of the core fitted portion 42 of the fitting member 4.

An annular-shaped sealing member 55 made of rubber is mounted to the outer periphery of the core fitted portion 42. The sealing member 55 restricts water from entering into the plughole 71. The case fitting portion 41 of the fitting member 4 and the connector case 3 fit together in a first fit region A1, and the core fitted portion 42 of the fitting member 4 and the outer core 24 fit together in a second fit region A2. In the ignition coil 1 of this embodiment, the first fit region A1 and the second fit region A2 are offset with respect to the axial direction D of the ignition coil 1. That is, the first fit region A1 is distant from the second fit region A2 with respect to the axial direction D. In this structure, the first fit region A1 and the second fit region A2 do not to overlap each other with respect to the axial direction D.

As referred to FIGS. 1, 2, the axial end of the coil case 25 on the side of the D1 in this embodiment is fitted into the inner periphery of the case fitting portion 41 of the fitting member 4. The other axial end of the coil case 25 on the side of the D2 is fitted to the mount base portion 212 of the primary spool 211. A thermosetting resin 11 such as epoxy resin is charged into a clearance defined by the connector case 3, the fitting member 4, the coil case 25, the mount base portion 212, and the high-voltage terminal 62. The thermosetting resin 11 is charged into a clearance between the center core 23 and the secondary coil 22, a clearance between the secondary coil 22 and the primary coil 21, a clearance between the primary coil 21 and the coil case 25, and a clearance in the connector case 3. The thermosetting resin 11 is formed by charging the liquid thermosetting resin into the clearance (space) formed in the assembly of the ignition coil 1, and by curing the charged thermosetting resin.

As referred to FIG. 1, the axial end of the case fitting portion 41 of the fitting member 4 on the side of the D1 is formed with a charged groove 411, into which the epoxy resin 11 being a thermosetting resin is charged. The charged groove 411 is formed to be annular-shape around the circumferential periphery of the fitting member 4. The reinforcement member 51 in this embodiment is embedded into the fitting member 4 by curing the liquid epoxy resin 11 charged into the charged groove 411.

Thermoplastic resin formed to be the fitting member 4 in this embodiment is polybutylene terephthalate (PBT). The thermosetting resin 11 charged into the clearances in the ignition coil 1 and the epoxy resin 11 charged into the charged groove 411 of the fitting member 4 are the same as each other. The epoxy resin 11 after curing is greater in Young's modulus and hardness than that of the thermosetting resin, which constructs the fitting member 4.

In this embodiment, after respective components are assembled, the liquid epoxy resin 11 is charged into the clearances in the ignition coil 1, and the epoxy resin 11 is also charged into the charged groove 411. After the charging of the epoxy resin 11, the epoxy resin 11 is cured, so that the epoxy resin 11 is embedded as the reinforcement member 51 in the fitting member 4. Thus, the ignition coil 1 is joined as a whole by the epoxy resin 11.

Figure 4:
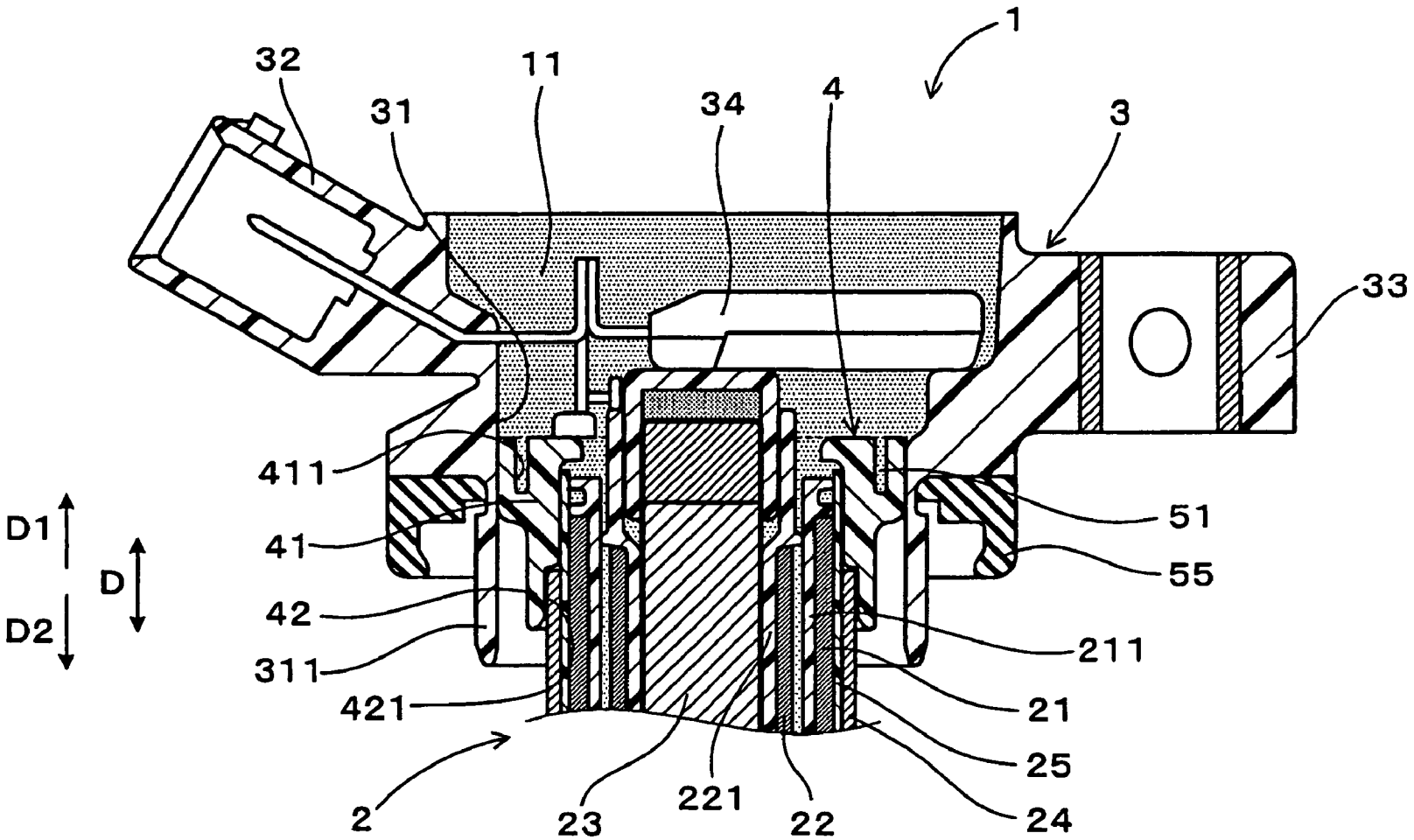
FIG. 4 is a partially sectional view showing a fitting member of the ignition coil.

As shown in FIG. 4, an extended portion 311 may be provided by extending the portion defining the fit hole 31 in the connector case 3 toward the other axial end on the side of the D2. In this case, the reinforcement member 51 can be embedded in the axial end of the fitting member 4 on the side of the D1.

Figure 5:
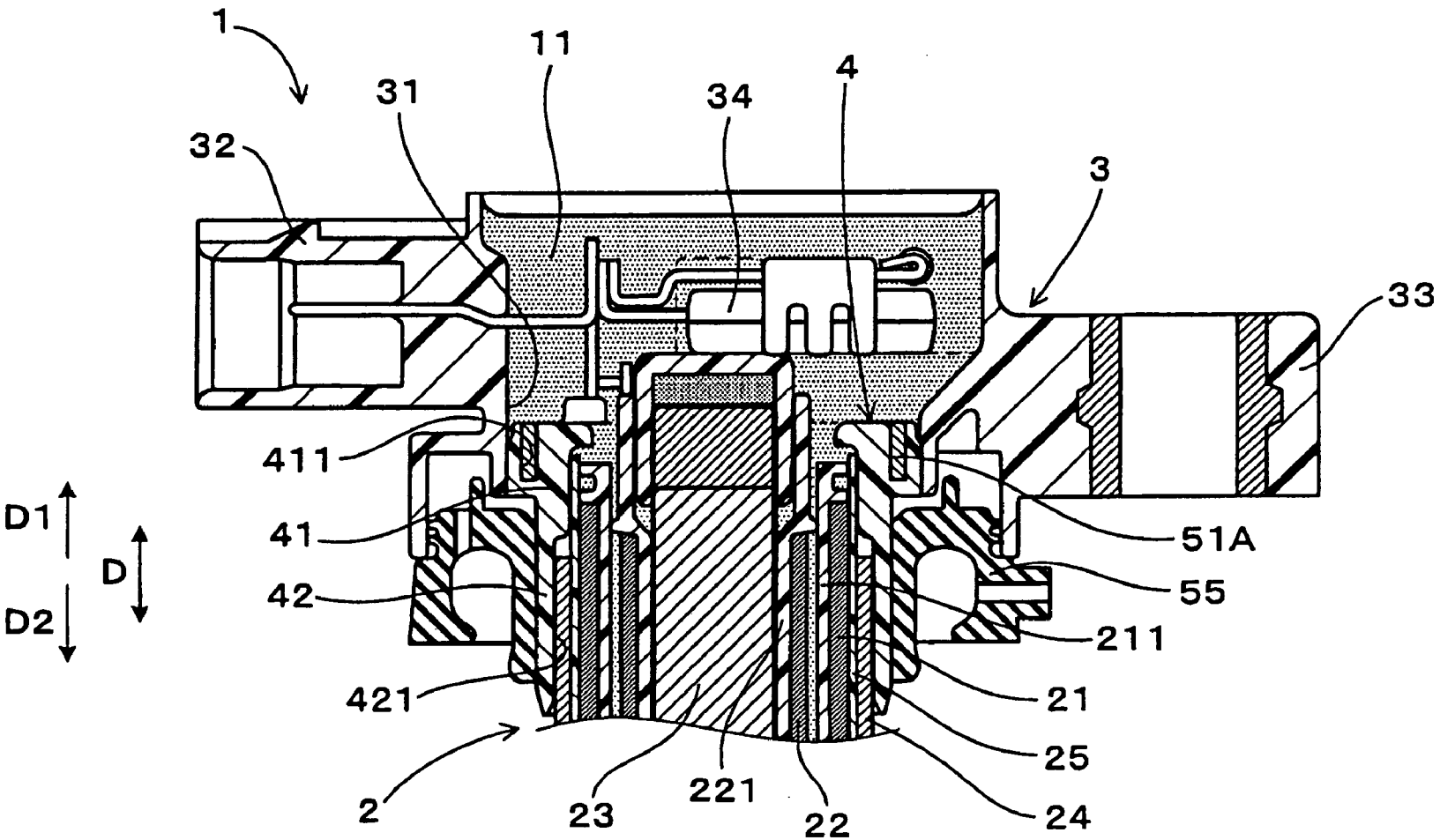
FIG. 5 is a partially sectional view showing a fitting member of the ignition coil.

As shown in FIG. 5, a metallic piece 51A in an annular shape may be provided along the circumferential periphery in the fitting member 4. The metallic piece 51A is insert-molded into the fitting member 4, so that the metallic piece 51A can be embedded into the fitting member 4. The insert-molding can be performed by charging a resin material into a forming die in a state, in which the metallic piece 51A is arranged in the forming die, at the time of forming the fitting member 4.

Figure 6:
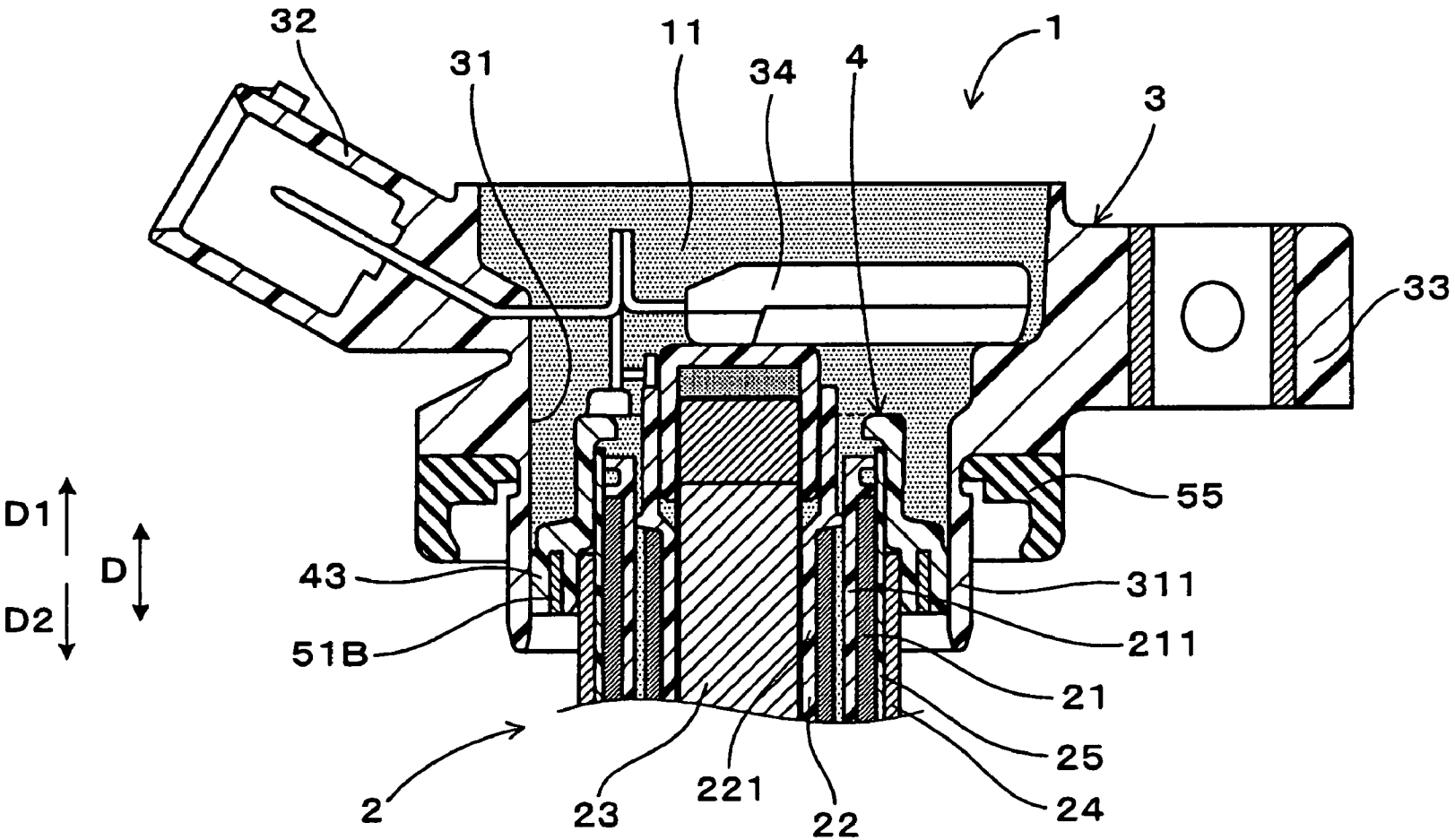
FIG. 6 is a partially sectional view showing a fitting member of the ignition coil.

As shown in FIG. 6, a metallic piece 51B as the reinforcement member 51 may be embedded in a fitting portion 43 formed in the other axial end of the fitting member 4 on the side of the D2. The metallic piece 51B may be insert-molded into the fitting member 4, the metallic piece 51B can be embedded in the fitting member 4.

In the ignition coil 1, when a pulse-shaped spark generation signal from the ECU enables an electric current to flow through the primary coil 21, a magnetic field is formed to pass through the center core 23 and the outer core 24. Subsequently, when an electric current flowing through the primary coil 21 is interrupted, an induction field passing through the center core 23 and the outer core 24 is formed in an opposite direction to that direction, in which the magnetic field is formed. By the formation of the induction field, the secondary coil 22 generates an induced electromotive force (back electromotive force) of high voltage, so that the spark plug 65 mounted to the plug mount 6 of the ignition coil 1 generates spark.

In the ignition coil 1 according to the embodiment, the reinforcement member 51 is embedded into the fitting member 4. The reinforcement member 51 has a Young's modulus greater than that of thermoplastic resin, which constructs the fitting member 4. The coil portion 2 is arranged in the plughole 71, so that the ignition coil 1 is assembled to the engine 7. In this condition, even when bending load acts on the ignition coil 1 due to vibration of the engine, such bending load acts on the fitting member 4 reinforced by the reinforcement member 51.

Thereby, even when stress due to the bending load acts concentratedly on the fitting member 4, the fitting member 4 and the ignition coil 1 can be protected from breakage. Therefore, the ignition coil 1 can be enhanced in bending strength when the coil portion 2 and the connector case 3 are assembled together via the cylindrical-shaped fitting member 4 therebetween.

Second Embodiment

The second embodiment is described with reference to FIGS. 7 to 11.

Figure 7:
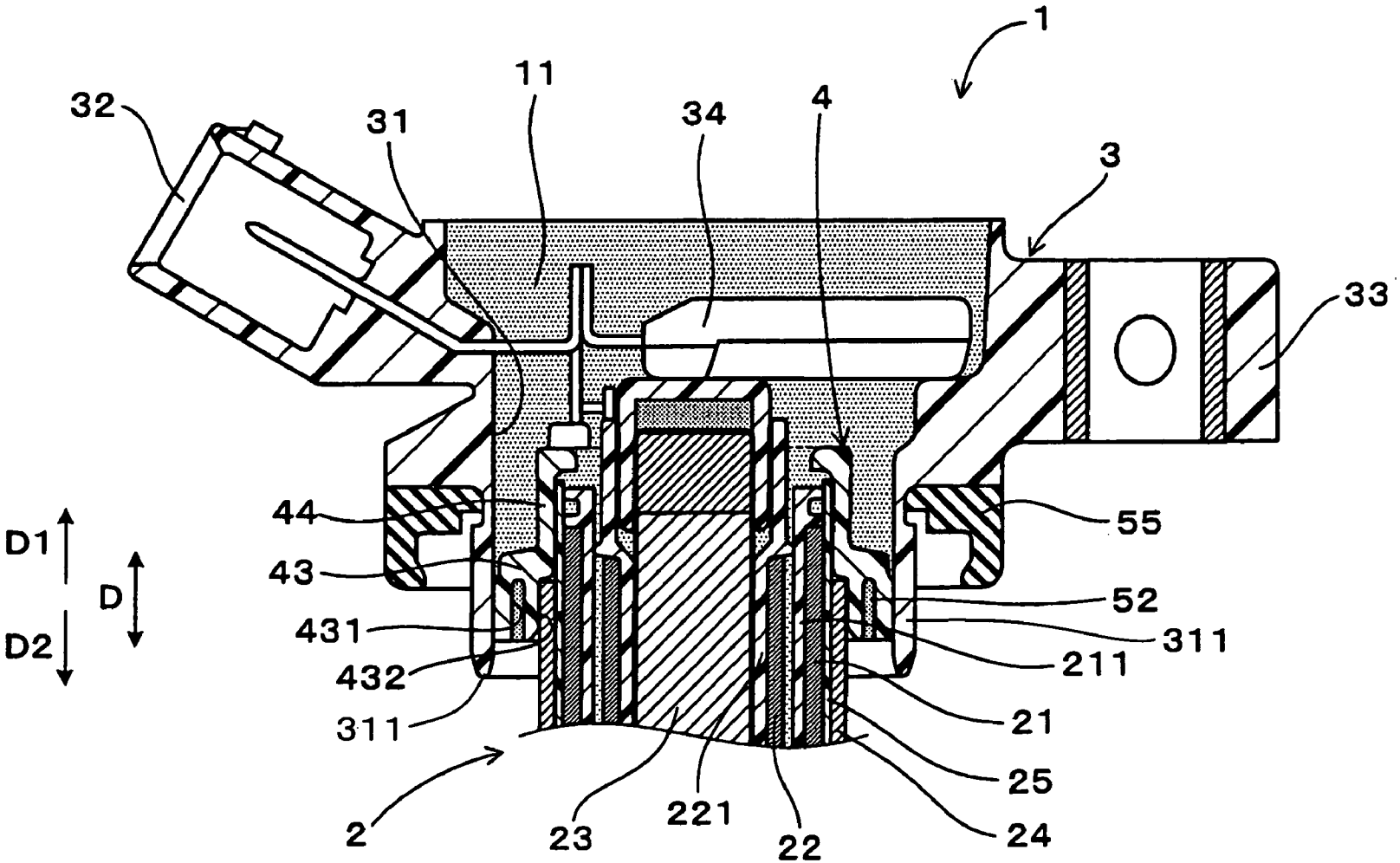
FIG. 7 is a partially sectional view showing an ignition coil including a fitting member connecting the coil portion with the connector case, according to a second embodiment.

As shown in FIG. 7, the outer periphery of the fitting member 4 is fitted into the fit hole 31 formed in the connector case 3. The outer core 24 is fitted into the inner periphery of the fitting member 4. According to the embodiment, an elastic member 52 is embedded into the fitting member 4. The elastic member 52 is formed of a material having a Young's modulus less than that of thermoplastic resin, which constructs the fitting member 4.

The fitting member 4 is made of the thermoplastic resin to be cylindrical-shaped, i.e., to be annular-shaped in cross section. The fitting portion 43 is formed in the other axial end of the fitting member 4 on the side of the D2. The outer periphery of the fitting portion 43 is fitted into the fit hole 31 of the connector case 3. The inner periphery of the fitting portion 43 is fitted to the outer core 24. A holding portion 44 is formed on the axial end of the fitting member 4 on the side of the D1. The holding portion 44 is fitted to the coil case 25.

In this embodiment, the elastic member 52 is embedded in the fitting portion 43. The elastic member 52 is arranged in an annular groove 431 formed circumferentially in the fitting portion 43. The elastic member 52 can be embedded in the fitting member 4 by insert-molding when the fitting member 4 is formed. Insert-molding can be performed by charging a resin material into a forming die in a state, in which the elastic member 52 is arranged in the forming die, at the time of forming the fitting member 4.

An annular fit groove 432 is formed in the inner periphery of the fitting portion 43. The fit groove 432 is fitted to the outer core 24. The axial end of the outer core 24 on the side of the D1 is fitted into the annular fit groove 432 defined on the core fitted portion 42 of the fitting member 4. The sealing member 55 is mounted to an extended portion 311 of the connector case 3. The extended portion 311 extends from the portion, which defines the fit hole 31 in the connector case 3, toward the D2.

Thermoplastic resin forming the fitting member 4 in this embodiment is polybutylene terephthalate (PBT), for example. The elastic member 52 embedded in the fitting member 4 is formed of, for example, an elastomer being less in Young's modulus and hardness than the thermosetting resin, which constructs the fitting member 4. The thermoplastic resin may be various thermoplastic resin other than PBT. The elastic member 52 may be formed of a resin foam or the like, other than elastomer.

Figure 8:
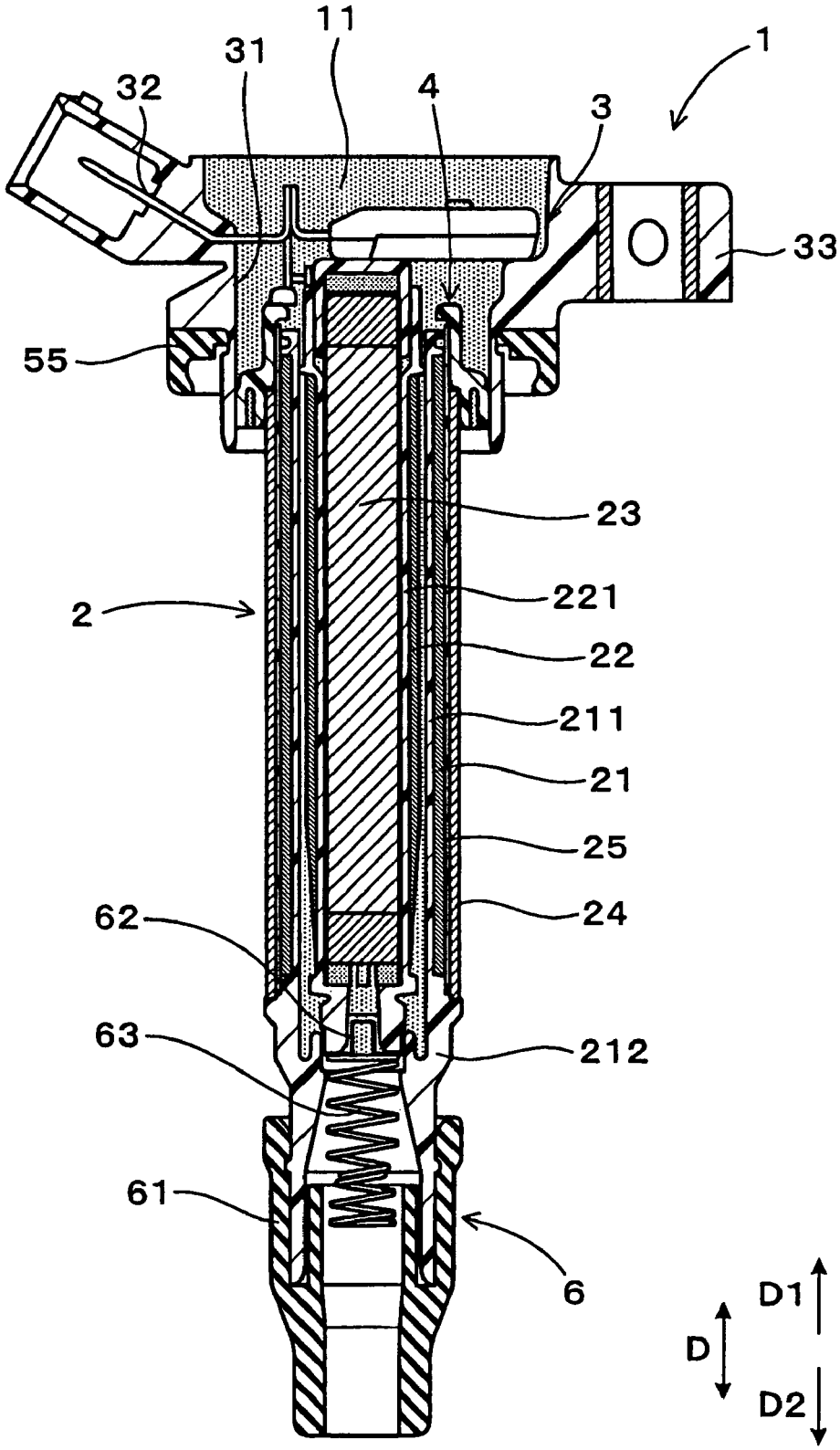
FIG. 8 is a partially longitudinal sectional view showing the ignition coil.
Figure 9:
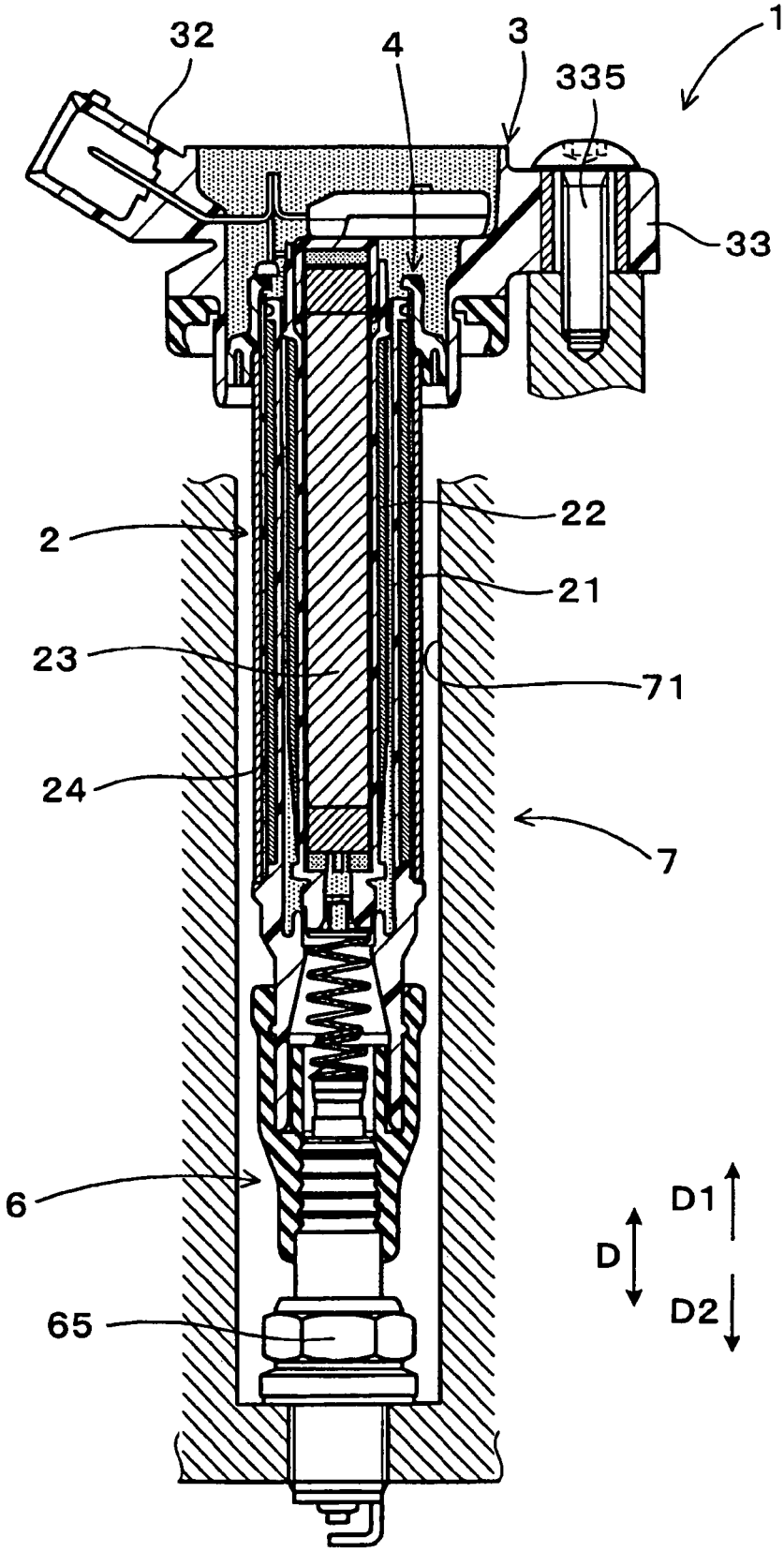
FIG. 9 is a partially longitudinal sectional view showing the ignition coil that is provided in the plug hole of the internal combustion engine.

As shown in FIG. 8, the axial end of the coil case 25 on the side of the D1 is fitted into the inner periphery of the holding portion of the fitting member 4. The other axial end of the coil case 25 on the side of the D2 is fitted to the mount base portion 212 of the primary spool 211. A thermosetting resin 11 such as epoxy resin or the like is charged into the clearance of the ignition coil 1 defined by the connector case 3, the fitting member 4, the coil case 25, the mount base portion 212, and the high-voltage terminal 62. The thermosetting resin 11 is charged into the clearance between the center core 23 and the secondary coil 22, the clearance between the secondary coil 22 and the primary coil 21, the clearance between the primary coil 21 and the coil case 25, and the clearance in the connector case 3. The thermosetting resin 11 is formed by charging the liquid thermosetting resin into the clearance (space) formed in the assembly of the ignition coil 1, and by curing the charged thermosetting resin.

Figure 10:
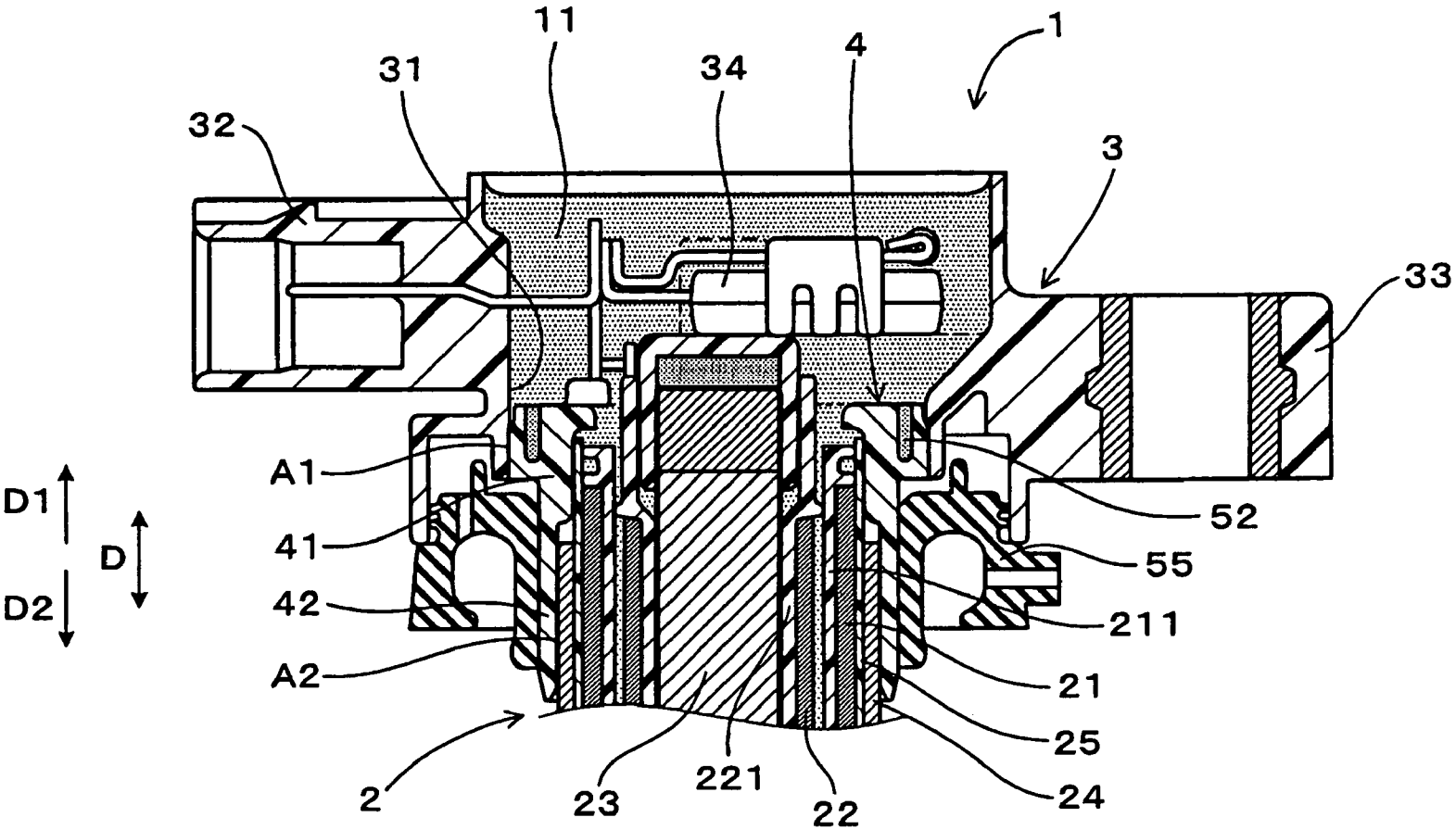
FIG. 10 is a partially sectional view showing a fitting member of the ignition coil.
Figure 11:
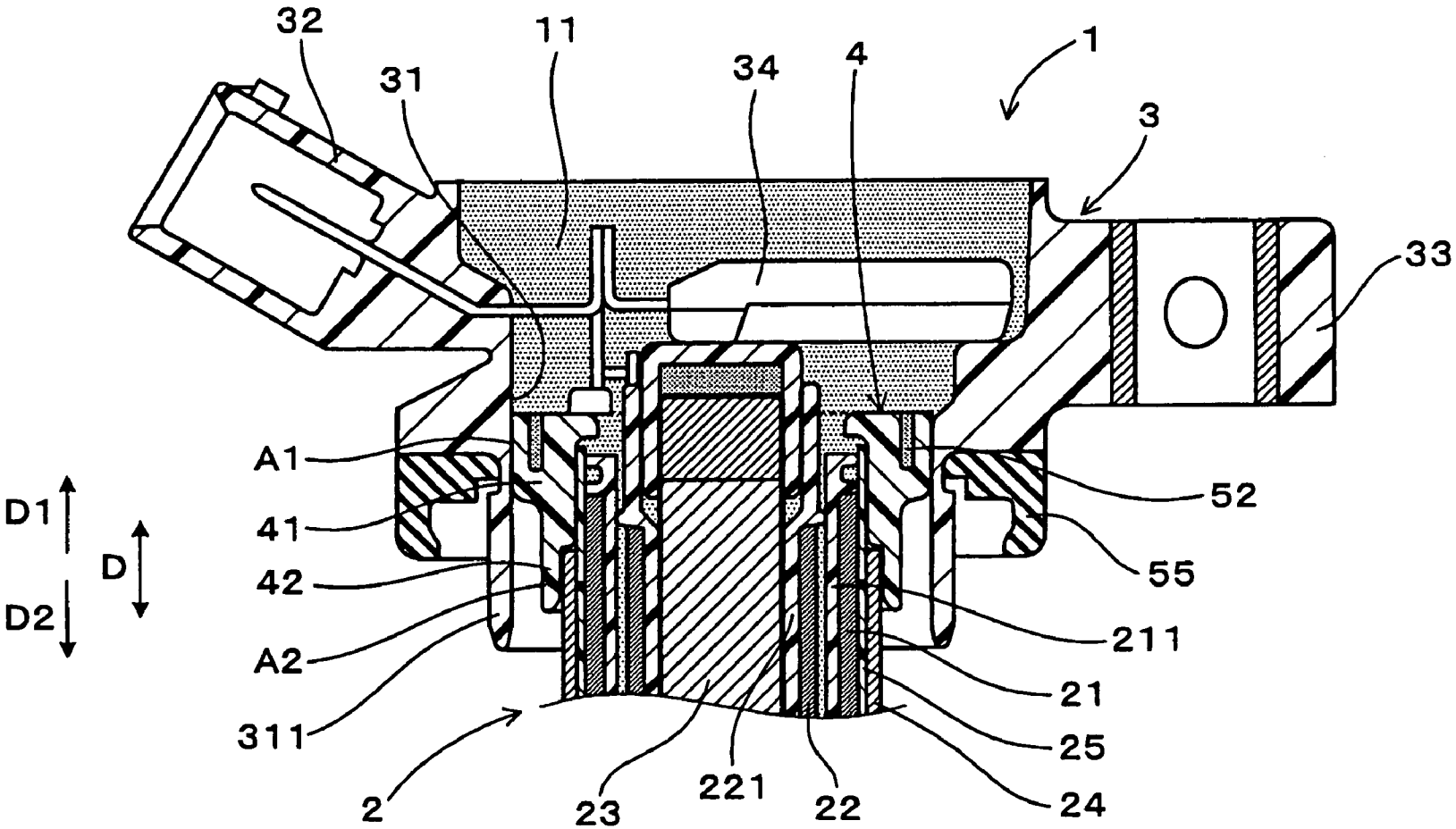
FIG. 11 is a partially sectional view showing a fitting member of the ignition coil.

As shown in FIGS. 10, 11, the elastic member 52 may be embedded in the axial end of the fitting member 4 on the side of the D1. In this case, a case fitting portion 41 is formed on the side of the D1 of the fitting member 4 to be fitted into the fit hole 31 of the connector case 3. A core fitted portion 42 is formed on the other axial end of the fitting member 4 on the side of the D2. The outer core 24 is fitted to the core fitted portion 42. The case fitting portion 41 of the fitting member 4 and the connector case 3 fit together in the first fit region A1. The core fitted portion 42 of the fitting member 4 and the outer core 24 fit together in the second fit region A2. The first fit region A1 and the second fit region A2 are offset with respect to the axial direction D. That is, the first fit region A1 is distant from the second fit region A2 with respect to the axial direction D. In this structure, the first fit region A1 and the second fit region A2 do not overlap each other with respect to the axial direction D.

As referred to FIG. 10, the sealing member 55 may be mounted to the outer periphery of the core fitted portion 42. As referred to FIG. 11, the sealing member 55 may be mounted to the extended portion 311 of the connector case 3.

The elastic member 52 is embedded in the fitting member 4. The elastic member 52 is less in Young's modulus than that of the thermosetting resin, which constructs the fitting member 4. The coil portion 2 is formed by assembling the primary coil 21, the secondary coil 22, the center core 23, and the outer core 24. When the coil portion 2 is fitted into the fit hole 31 of the connector case 3 via the fitting member 4 therebetween, the fitting member 4 can be appropriately deformed at the elastic member 52. Thereby, the ignition coil 1 can be improved in quality of assembly.

The elastic member 52 is embedded in the fitting member 4, so that a groove defining an air layer can be reduced from the fitting member 4. Therefore, the strength of the fitting member 4 can be maintained.

The coil portion 2 is arranged in the plughole 71, so that the ignition coil 1 is assembled to the engine. In this condition, even when stress due to the bending load acts concentratedly on the fitting member 4 due to vibration of the engine, the fitting member 4 and the ignition coil 1 can be protected from breakage.

Therefore, the ignition coil 1 can be enhanced in quality of assembly and bending strength when the coil portion 2 and the connector case 3 are assembled together via the cylindrical-shaped fitting member 4 therebetween.

Third Embodiment

The third embodiment is described with reference to FIGS. 12 to 16.

Figure 12:
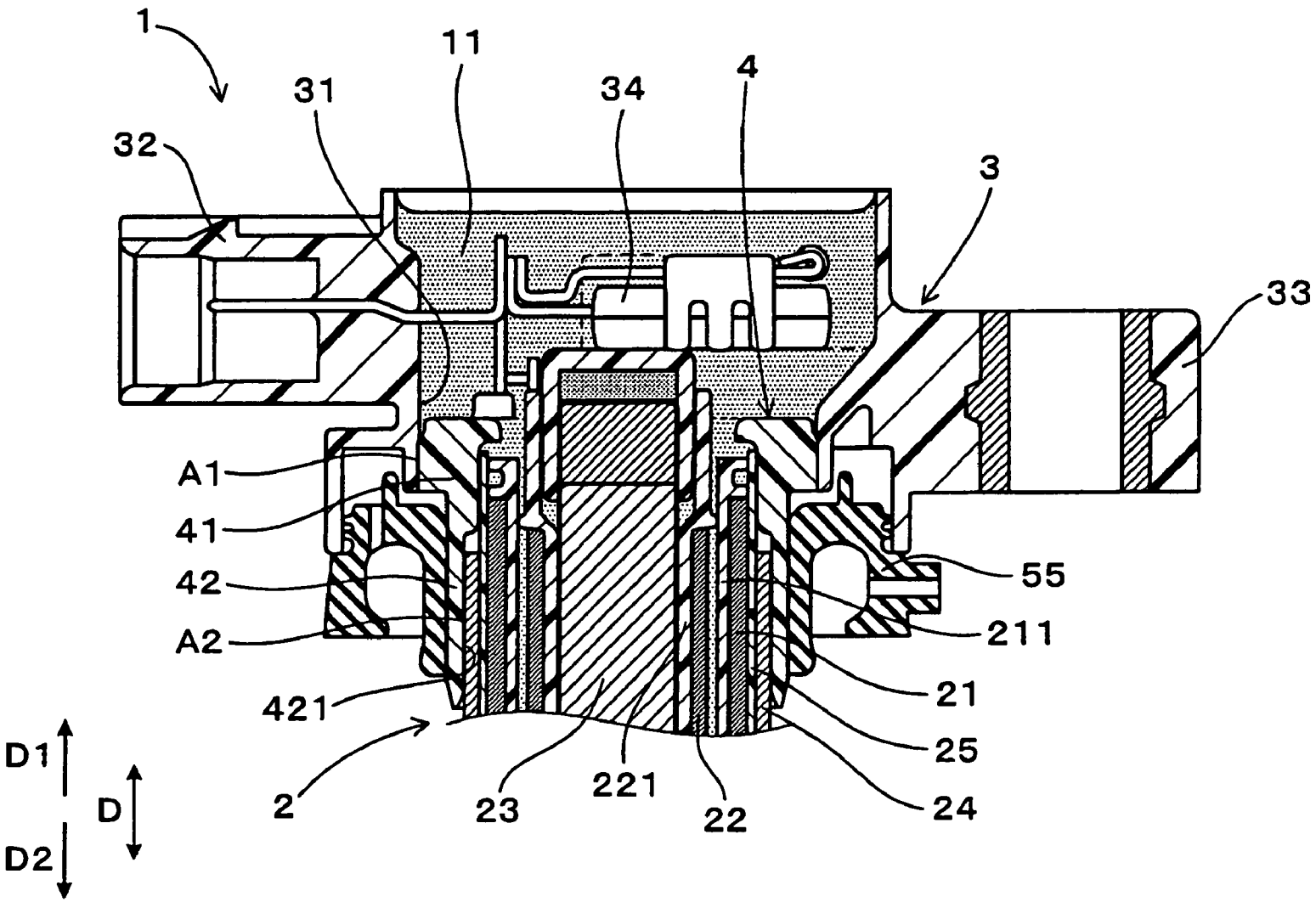
FIG. 12 is a partially sectional view showing the ignition coil including the fitting member connecting the coil portion with the connector case, according to a third embodiment.

As referred to FIG. 12, the outer periphery of the fitting member 4 on the side of the D1 is fitted into the fit hole 31 formed on the connector case 3. The inner periphery of the fitting member 4 on the other axial end on the side of the D2 is fitted to the outer core 24. The fitting member 4 and the connector case 3 fit together in the first fit region A1. The fitting member 4 and the outer core 24 fit together in the second fit region A2. The fit regions A1, A2 are defined offset with respect to the axial direction D of an ignition coil 1. In this structure, the fit regions A1, A2 are distant from each other with respect to the axial direction D, so as not to overlap each other in the axial direction D.

The fitting member 4 is made of thermoplastic resin formed to be cylindrical-shaped. The case fitting portion 41 is formed in the axial end of the fitting member 4 on the side of the D1. The case fitting portion 41 is fitted into the fit hole 31 of the connector case 3. The core fitted portion 42 is formed on the other axial end of the fitting member 4 on the side of the D2. The core fitted portion 42 is fitted to the outer core 24. The first fit region A1 is defined between the case fitting portion 41 and the connector case 3. The second fit region A2 is defined between the core fitted portion 42 and the outer core 24.

The annular fit groove 421 is formed on the inner periphery of the core fitted portion 42. The fit groove 421 is fitted to the outer core 24. The axial end of the outer core 24 on the side of the D1 is fitted into the fit groove 421 defined on the core fitted portion 42 of the fitting member 4. The annular-shaped sealing member 55 made of, for example, rubber is mounted to the outer periphery of the core fitted portion 42. The sealing member 55 restricts water from entering into a plughole 71.

In this structure, the end of the outer core 24 can be stably inserted into the inner periphery of the fitting member 4 using the sealing member 55. Furthermore, in this structure, the sealing member 55 can be provided by utilizing the outer periphery of the fitting member 4, so that the ignition coil can be downsized.

Figure 13:
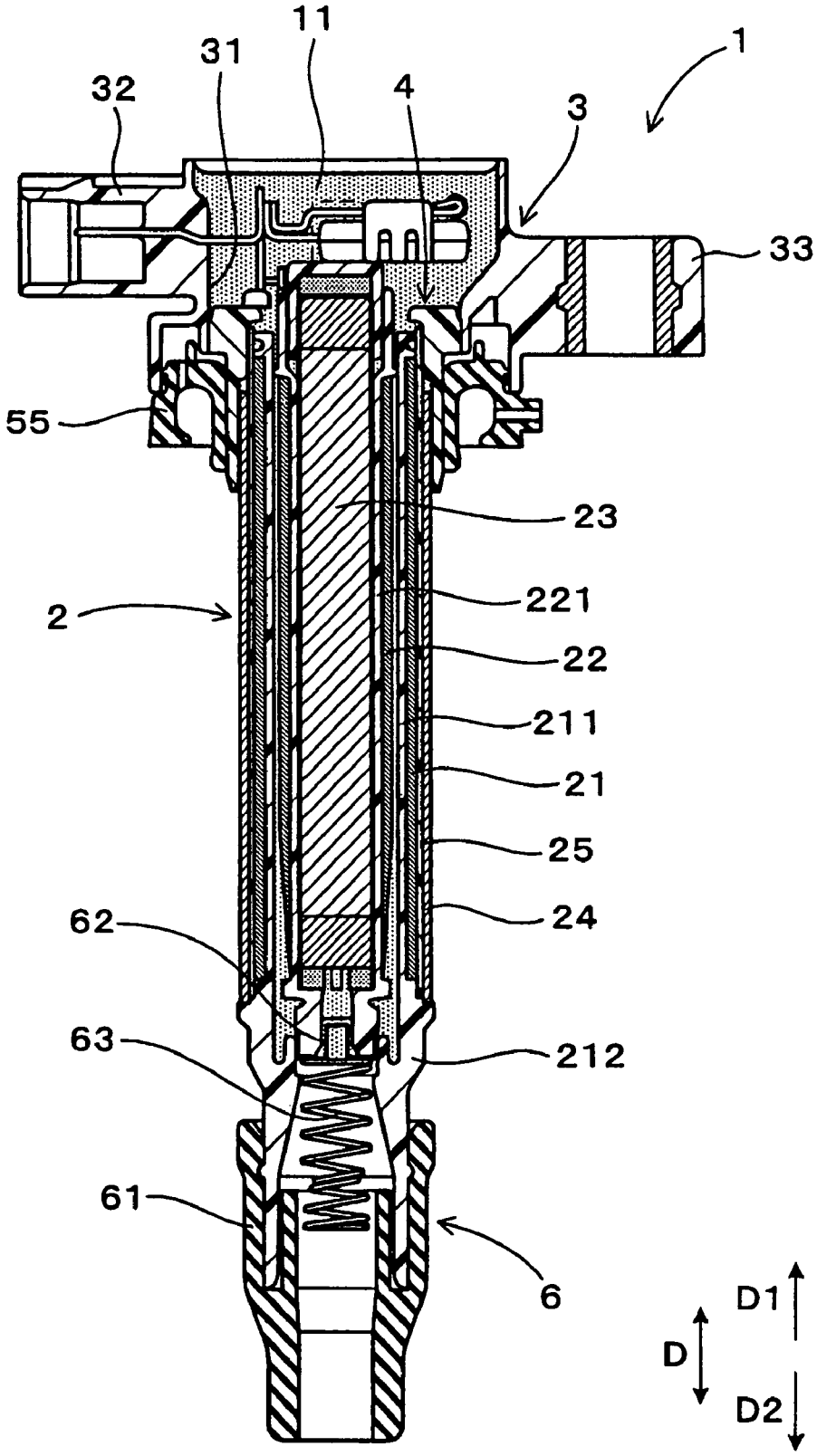
FIG. 13 is a partially longitudinal sectional view showing the ignition coil.
Figure 14:
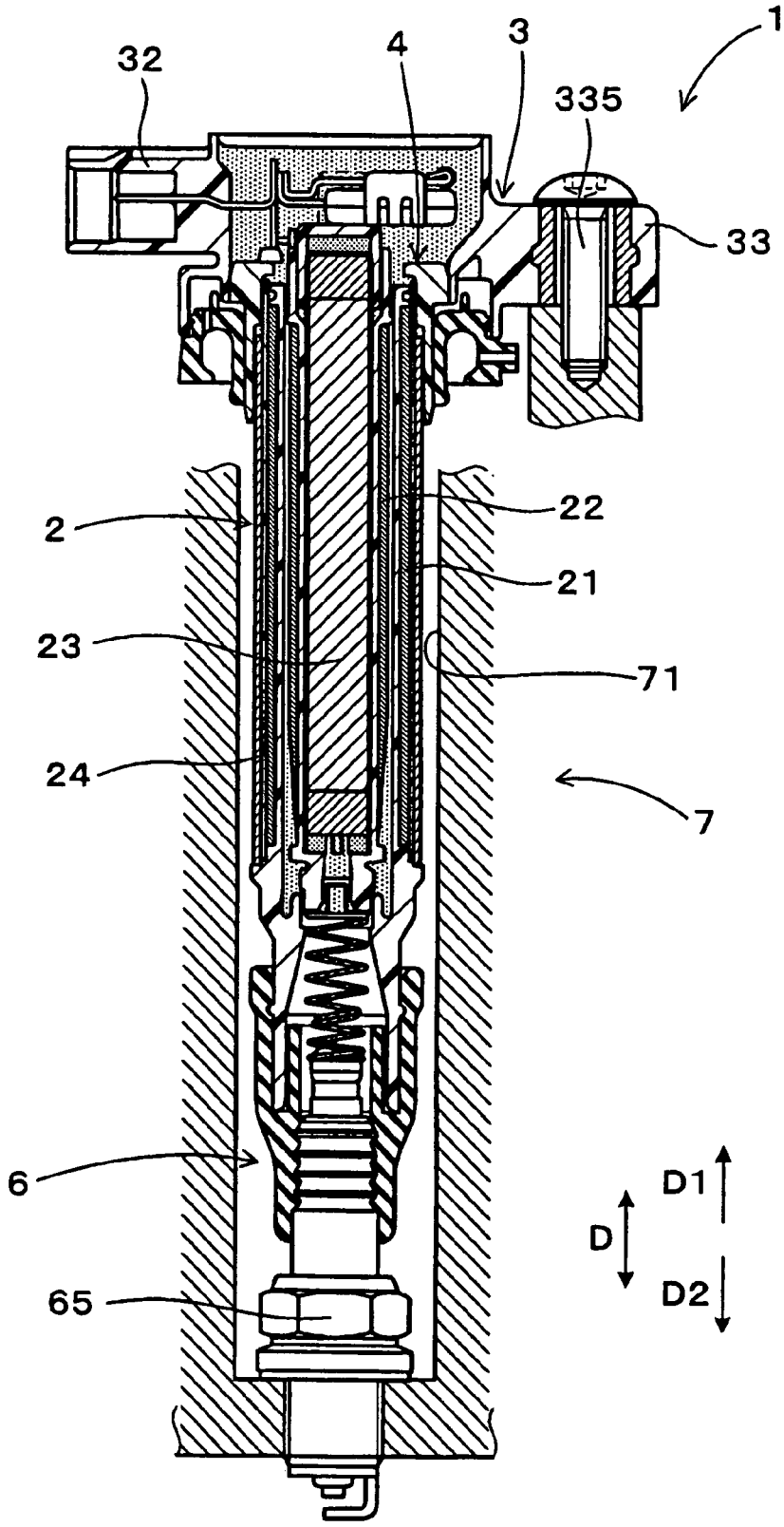
FIG. 14 is a partially longitudinal sectional view showing the ignition coil that is provided in the plug hole of the internal combustion engine.

As shown in FIGS. 13, 14, the axial end of the coil case 25 on the side of the D1 in this embodiment is fitted into the inner periphery of the case fitting portion 41 of the fitting member 4. The other axial end of the coil case 25 on the side of the D2 is fitted to the mount base portion 212 of the primary spool 211. The thermosetting resin 11 such as epoxy resin is charged into the clearance in the ignition coil 1, which is defined by the connector case 3, the fitting member 4, the coil case 25, the mount base portion 212, and the high-voltage terminal 62. The thermosetting resin 11 is charged into the clearance between the center core 23 and the secondary coil 22, the clearance between the secondary coil 22 and the primary coil 21, the clearance between the primary coil 21 and the coil case 25, and the clearance in the connector case 3. The thermosetting resin 11 is formed by charging the liquid thermosetting resin into the clearance (space) formed in the assembly of the ignition coil 1, and by curing the charged thermosetting resin.

The first fit region A1, in which the fitting member 4 and the connector case 3 fit together, and the second fit region A2, in which the fitting member 4 and the outer core 24 fit together, are defined in the state of not overlapping each other with respect to the axial direction D. Therefore, when bending load by vibrations of the engine 7 acts on the ignition coil 1 in the state, in which the coil portion 2 is arranged in the plughole 71 and the ignition coil 1 is assembled to the engine 7, such bending load acts dispersedly in the first fit region A1 and the second fit region A2. Thus, bending load can be deconcentrated in the ignition coil 1. In the ignition coil 1, bending nodes are defined at two locations, that is, the first fit region A1 and the second fit region A2.

In this structure, stress can be restricted from concentrated on one location in the ignition coil 1, so that stress is applied dispersedly to the first fit region A1 and the second fit region A2. With the ignition coil 1 according to the embodiment, the ignition coil 1 can be enhanced in bending strength in the case where the coil portion 2 and the connector case 3 are assembled together via the cylindrical-shaped fitting member 4 therebetween.

Figure 15:
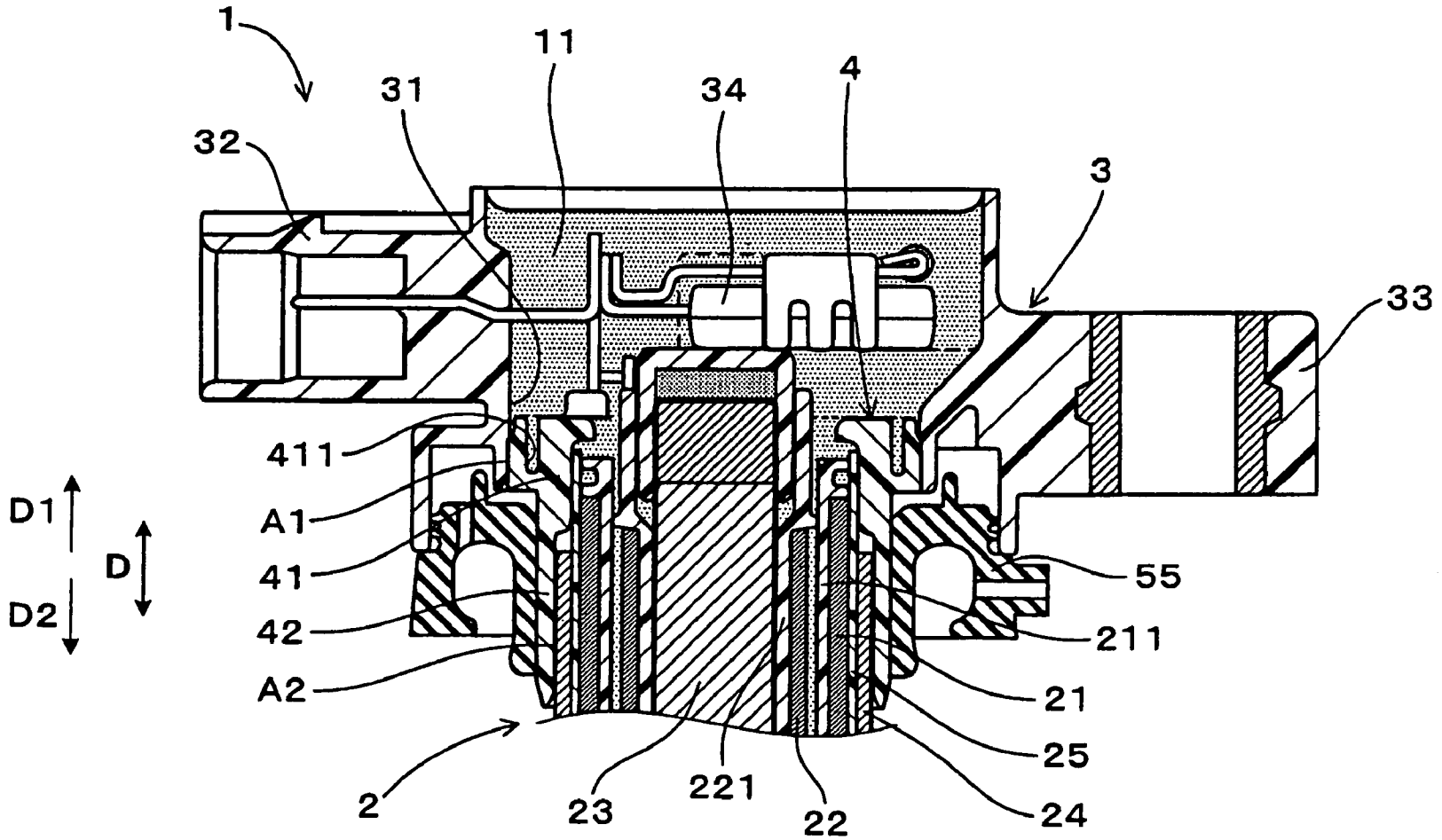
FIG. 15 is a partially sectional view showing a fitting member of the ignition coil.

As referred to FIG. 15, the axial end of the case fitting portion 41 of the fitting member 4 on the side of the D1 may be formed with the annular charged groove 411, into which the thermosetting resin 11 such as epoxy resin or the like is charged. When the thermosetting resin 11 is charged into the clearance in the ignition coil 1, the thermosetting resin 11 is also charged into the charged groove 411. In this case, the thermosetting resin 11 being greater in hardness and Young's modulus than the thermosetting resin, which constructs the fitting member 4, is embedded into the case fitting portion 41 of the fitting member 4. Therefore, the first fit region A1 between the fitting member 4 and the connector case 3 can be improved in strength of fitting.

Figure 16:
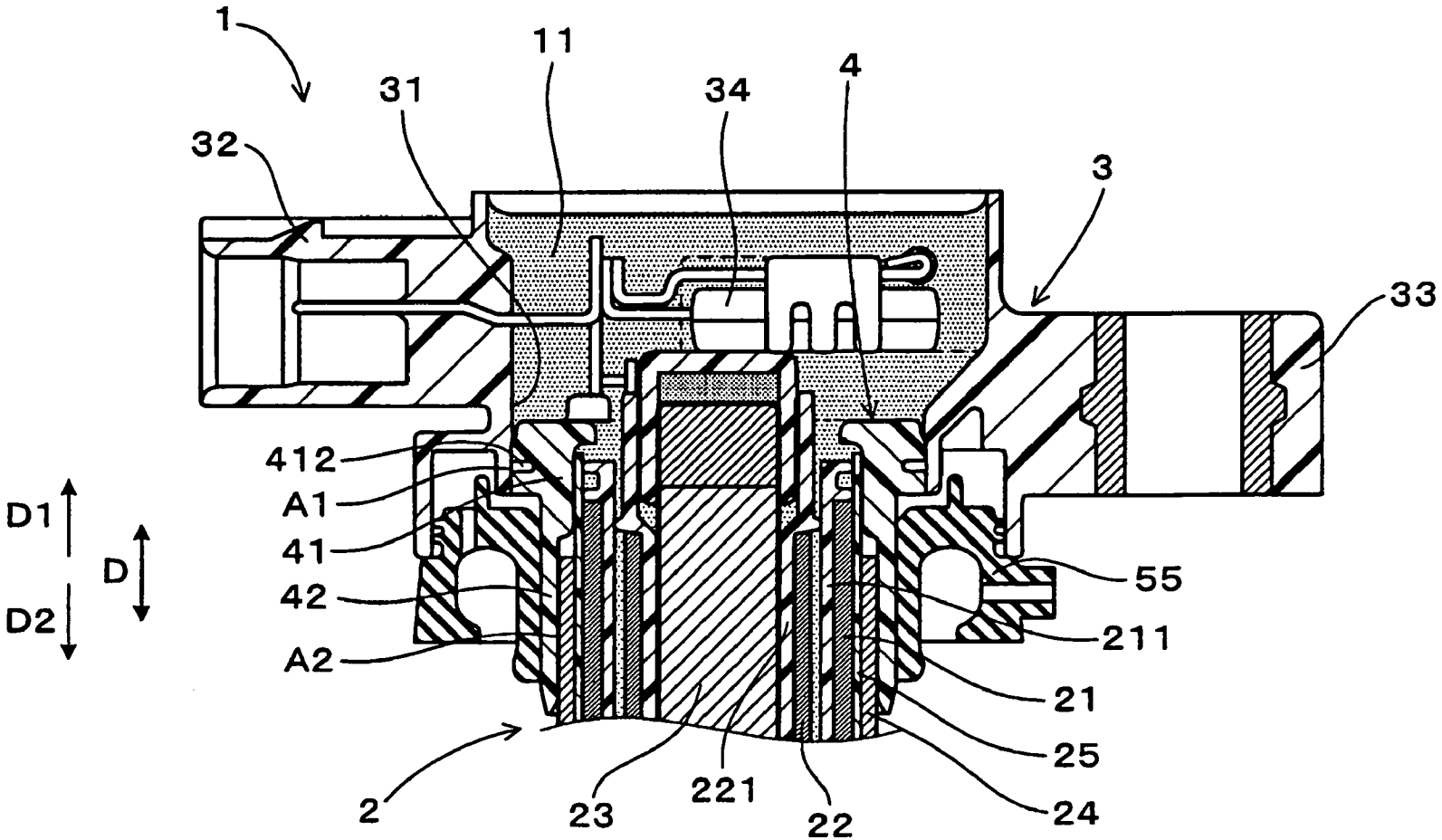
FIG. 16 is a partially sectional view showing a fitting member of the ignition coil.

As referred to FIG. 16, an annular groove 412 may be formed on a surface in the first fit region A1 on the fitting member 4. In this case, the annular groove 412 divides the first fit region A1, in which the fitting member 4 and the connector case 3 fit together, with respect to the axial direction D. Therefore, when bending load by vibrations of the engine 7 acts on the ignition coil 1, stress applied to the first fit region A1 can be further dispersed and the ignition coil 1 can be improved in bending strength.

The arrangement among the primary coil and the secondary coil is an example. The components of the ignition coil such as the primary coil and the secondary coil may be determined as appropriate.

The reinforcement member 51 may be formed of a material, which is greater than the thermoplastic resin in Young's modulus, such as ceramic, other than the epoxy resin and metallic material.

The elastic member 52 may be formed of a material, which is less than the thermoplastic resin in Young's modulus, such as soft resin, rubber, in particular elastomer, and gel. The elastic member 52 may be a foam member.

The fitting member 4 may be formed of metal or ceramic. In this case, the elastic member 52 may be formed of a material, which is less than the metal or ceramic constructing the fitting member 4 in Young's modulus, such as metal, ceramic, resin, rubber, and gel.

The above structures of the embodiments can be combined as appropriate. That is, for example, the reinforcement member 51 such as the metallic pieces 51A, 51B in the first embodiment, the elastic member 52 in the second embodiment, the annular groove 412 in the third embodiment, and the arrangement of the first and second regions A1, A2 may be combined for designing of the structure of the ignition coil. The ignition coil can be further enhanced in strength, flexibility, and vibration characteristic by properly arrangement of a high-rigidity portion, a low-rigidity portion, and a space in the ignition coil.

Various modifications and alternations may be diversely made to the above embodiments without departing from the spirit of the present invention.

What is claimed is:

1. An ignition coil comprising:

a coil portion that includes a primary coil, a secondary coil, a center core, and an outer core, the center core being arranged on a radially inner side of both the primary coil and the secondary coil, the outer core being arranged on a radially outer side of both the primary coil and the secondary coil;

a fitting member that is in a substantially cylindrical shape, the fitting member having an inner periphery via which the fitting member is fitted to the outer core; and a connector case that includes a connector portion and a flange portion, the connector case having a fit hole via which the connector case is fitted to an outer periphery of the fitting member, wherein the connector case connects with an axial end of the coil portion via the fitting member, the fitting member includes a reinforcement member that is at least partially embedded in the fitting member, the fitting member is formed of thermoplastic resin, and the reinforcement member is formed of a material that is greater in Young's modulus than the thermoplastic resin constructing the fitting member.

2. The ignition coil according to claim 1, wherein the fitting member has one axial end having an outer periphery that is fitted into the fit hole, the fitting member has an other axial end having an inner periphery fitted to the outer core, and the reinforcement member is at least partially embedded into the fitting member from the one axial end.

3. The ignition coil according to claim 1, wherein the fitting member has one axial end having an outer periphery that is fitted into the fit hole, the fitting member has an other axial end having an inner periphery fitted to the outer core, and the reinforcement member is at least partially embedded into the fitting member from the other axial end.

4. The ignition coil according to claim 1, wherein the reinforcement member is formed of epoxy resin, which is greater in Young's modulus than the thermoplastic resin constructing the fitting member.

5. The ignition coil according to claim 1, wherein the reinforcement member includes a metallic piece, which is formed of the material greater in Young's modulus than the thermoplastic resin constructing the fitting member, and the metallic piece is insert-molded in the fitting member.

6. An ignition coil comprising:

a coil portion that includes a primary coil, a secondary coil, a center core, and an outer core, the center core being arranged on a radially inner side of both the primary coil and the secondary coil, the outer core being arranged on a radially outer side of both the primary coil and the secondary coil;

a fitting member that is in a substantially cylindrical shape, the fitting member having an inner periphery via which the fitting member is fitted to the outer core; and a connector case that includes a connector portion and a flange portion, the connector case having a fit hole via which the connector case is fitted to an outer periphery of the fitting member, wherein the connector case connects with an axial end of the coil portion via the fitting member, the fitting member includes an elastic member that is at least partially embedded in the fitting member, and the elastic member is formed of a material that is less in Young's modulus than a material constructing the fitting member.

7. The ignition coil according to claim 6, wherein the fitting member has one axial end having an outer periphery that is fitted into the fit hole, the fitting member has an other axial end having an inner periphery fitted to the outer core, and the elastic member is at least partially embedded into the fitting member from the one axial end.

8. The ignition coil according to claim 6, wherein the fitting member has one axial end having an outer periphery that is fitted into the fit hole, the fitting member has an other axial end having an inner periphery fitted to the outer core, and the elastic member is at least partially embedded into the fitting member from the other axial end.

9. The ignition coil according to claim 6, wherein the fitting member is formed of thermoplastic resin, and the elastic member is formed of one of a resin, rubber, and gel, which is less in Young's modulus than the thermoplastic resin.

10. An ignition coil comprising:

a coil portion that includes a primary coil, a secondary coil, a center core, and an outer core, the center core being arranged on a radially inner side of both the primary coil and the secondary coil, the outer core being arranged on a radially outer side of both the primary coil and the secondary coil;

a fitting member that is in a substantially cylindrical shape, the fitting member having one axial end and an other axial end, the other axial end having an inner periphery via which the fitting member is fitted to the outer core; and a connector case that includes a connector portion and a flange portion, the connector case having a fit hole via which the connector case is fitted to an outer periphery of the one axial end of the fitting member, wherein the connector case connects with an axial end of the coil portion via the fitting member, the fitting member is fitted to the connector case in a first fit region, the fitting member is fitted to the outer core in a second fit region, and the first fit region is axially distant from the second fit region.

11. The ignition coil according to claim 10, wherein the fitting member has a surface defining an annular groove in the first fit region.

12. The ignition coil according to claim 10, wherein the other axial end of the fitting member has the inner periphery defining a fit groove to which the outer core is fitted, the ignition coil further comprising:

a sealing member that is provided to the outer periphery of the other axial end of the fitting member.

13. The ignition coil according to claim 12, wherein the coil portion is arranged in a plughole of an internal combustion engine, and the sealing member restricts water from entering the plughole.

14. An ignition coil comprising:

a coil portion that includes a primary coil, a secondary coil, a center core, and an outer core, the center core being arranged on a radially inner side of both the primary coil and the secondary coil, the outer core being arranged on a radially outer side of both the primary coil and the secondary coil;

a fitting member that is in a substantially cylindrical shape, the fitting member having an inner periphery via which the fitting member is fitted to the outer core; and a connector case that has a fit hole via which the connector case is fitted to an outer periphery of the fitting member, wherein the connector case connects with an axial end of the coil portion via the fitting member, the fitting member includes an embedded member that is at least partially embedded in the fitting member, and the embedded member is formed of a material that is different in Young's modulus from a material constructing the fitting member.

* * * * *